US006976911B2

(12) United States Patent
Lanham et al.

(10) Patent No.: US 6,976,911 B2
(45) Date of Patent: Dec. 20, 2005

(54) METHOD AND APPARATUS FOR FILTERING AIRBORNE CONTAMINANTS

(75) Inventors: Gerry Lanham, Cincinnati, OH (US); Kenneth E. Lanham, Fort Wayne, IN (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/419,789

(22) Filed: Apr. 22, 2003

(65) Prior Publication Data

US 2004/0214518 A1 Oct. 28, 2004

(51) Int. Cl.[7] ..... F24F 1/00
(52) U.S. Cl. ..... 454/236; 454/238; 236/49.1
(58) Field of Search ..... 236/49.3; 454/229, 454/230, 234, 255, 256; 55/385.2

(56) References Cited

U.S. PATENT DOCUMENTS 3,150,584 A * 9/1964 Allander ..... 454/187
4,202,676 A * 5/1980 Pelosi et al. ..... 96/416
4,717,402 A * 1/1988 Lutterbach et al. ..... 55/467.1
5,086,692 A * 2/1992 Welch et al. ..... 454/187
5,294,049 A * 3/1994 Trunkle et al. ..... 236/49.5
5,331,991 A * 7/1994 Nilsson ..... 135/93
5,564,626 A * 10/1996 Kettler et al. ..... 236/49.3
5,590,830 A * 1/1997 Kettler et al. ..... 236/49.3
5,626,820 A * 5/1997 Kinkead et al. ..... 422/122
5,761,908 A * 6/1998 Oas et al. ..... 62/3.2
6,079,627 A * 6/2000 Kettler ..... 236/49.3
6,102,977 A * 8/2000 Johnson ..... 55/385.2
6,293,861 B1 * 9/2001 Berry ..... 454/255
6,583,726 B1 * 6/2003 Johnson et al. ..... 340/627
6,601,356 B2 * 8/2003 Snyder ..... 52/302.1
6,629,886 B1 * 10/2003 Estepp ..... 454/229
6,692,348 B1 * 2/2004 Cauthorne ..... 454/230

* cited by examiner

*Primary Examiner*—Dererk S. Boles
(74) *Attorney, Agent, or Firm*—Baker & Hostetler LLP

(57) ABSTRACT

A method and apparatus for removing airborne contaminants in residential or commercial buildings injects filtered air into these enclosures. Prior to be injected in these enclosures, the air is filtered for chemical, biological or radioactive hazards. The filtering of the air ensures that the enclosure is a safe haven. The apparatus includes an enclosure, a filtration assembly for removing airborne biological, chemical or radioactive agents mounted with the enclosure. A series of expansion slots can be mounted within the enclosure to assembly a multi-stage filtering process. A blower is also included in the apparatus for overcoming the resistance of the filtration assembly and increases the air pressure inside the building to achieve protective overpressure. A control system within the apparatus monitors the pressure and adjusts the airflow in the system in order to maintain the protective overpressure.

24 Claims, 2 Drawing Sheets

METHOD AND APPARATUS FOR FILTERING AIRBORNE CONTAMINANTS

FIELD OF THE INVENTION

The present invention relates generally to air circulation through the use of heating, ventilating and air conditioning (HVAC) equipment. More particularly, the present invention relates to filtering chemical or biological contaminants released in the environment and passing the filtered air through a ventilation system.

BACKGROUND OF THE INVENTION

Recent terrorist activity has underscored the relative lack of protection afforded to the general population from weapons of mass destruction. Occupants of buildings are especially vulnerable to airborne contaminants such as highly toxic chemical agents possibly used in terrorist attacks or toxic chemical accidents. These highly infectious chemical or biological agents can be used by terrorists or in weapons of mass destruction. The harmful agents are transmitted through the air in an effort to harm those within its path.

Although military systems exist which can protect individual soldiers in the field from these types of weapons, they have the disadvantage of high costs. Another disadvantage is the severe degradation in the ability of individuals to perform even the simplest tasks.

The military has also developed collective protection devices for creating relatively small protected areas. This is accomplished through the use of inflatable field hospitals and vehicle interiors.

For larger buildings, the Army Corps of Engineers has developed protection criteria that include air locks and heavy filtration systems. None of these approaches meet the needs of protecting the general population from airborne contaminants in a cost-effective manner.

Chemical, biological, or radioactive weapons are most destructive when deployed against civilian populations. When such a weapon is activated or detonated near an office, school, hospital, fire or police building, airbore agents may rapidly penetrate the building through the HVAC system doors, windows and leaks in the walls. Even if the filtration has been included on the basic HVAC system, airborne agents can penetrate the openings that are present in virtually all modern buildings.

Most residential, commercial and government buildings have not implemented measures to protect the inhabitants other than the very few people in the internal building enclosures designed with portable or built-in overpressure systems. It is also difficult or impossible to function effectively as a business or government entity if staff must remain in small protected spaces during an alert or a possible attack. In addition, buildings that have been the subject to an attack and which only provide small protected areas must be decontaminated at great expense and questionable effectiveness. Therefore, there is a need for a highly effective system that can be installed in an existing and new-build residential, commercial, or governments buildings to protect all occupants and the building interior itself from exposure to airborne agents.

A variety of devices for purifying the airflow into or out of an enclosure are available. U.S. Pat. No. 6,383,241 to Janus et al. discloses a protective filtration system for enclosures within buildings that is low-cost and portable.

U.S. Pat. No. 4,790,863 to Nobiraki et al. discloses a thin, lightweight fan module having one or more fans contained with the casing, a thin lightweight air filter module and a porous air flow modulator disposed between the fan module and the air filter module.

U.S. Pat. No. 4,905,578 to Curtis et al. discloses a portable enclosure for ventilating controlled areas that includes a blower located in an enclosure.

U.S. Pat. No. 5,462,484 to Jung et al. and U.S. Pat. No. 5,876,279 to Renz et al disclose a self-contained air cleaning system for use in a clean room.

However, none of these references provide for an air injection system which contains all of the items needed to effectively protect all the occupants from exposure to dangerous biological, radioactive, or chemical agents and which can be used cost-effectively with the current building existing HVAC system.

Accordingly, it is desirable to provide a method an apparatus that is able to filter out airborne contaminants before they are spread through an occupied building through the use of an HVAC system.

SUMMARY OF THE INVENTION

The foregoing needs are met, to a great extent, by the present invention, wherein in one aspect an apparatus is provided that in some embodiments a filter assembly is attached to an existing HVAC unit and is activated with a switch in the event of airborne contaminants become present in the exterior environment. The filter system prevents this potentially harmful contaminants from entering a building and affecting the inhabitants.

In accordance with one embodiment of the present invention, a filtration system for protecting occupants in an enclosed structure such as a building or house from airborne contaminants includes an enclosure having a first opening and a second opening, wherein the first opening is linked to an HVAC unit and the second opening is an intake for outside air to pass through to the HVAC unit, a filtration assembly mounted within the enclosure between the first and second opening and a blower mounted within the enclosure that draws the outside air to pass through the filter assembly. The filtration system can also include a control module that is attached to the blower. The control module can include both a rheostat and a pressure gauge. The rheostat is used in conjunction with the pressure gauge to ensure that a positive pressure is maintained in the building as compared to the pressure in the outside environment. The rheostat is used to adjust the operation of the blower to ensure the positive pressure is maintained.

The filter assembly can also include a filter to remove the airborne contaminants resulting from a chemical, biological or radioactive explosion. The filter can be a single or multi-stage filter. The filter can be a HEPA and/or charcoal filter.

In accordance with another embodiment of the present invention, a method of filtering airborne contaminants with a HVAC unit located within an inhabited enclosure includes sensing airborne contaminants in an outside environment, closing intake vents that draw in non-filtered air into the HVAC system, activating a blower to draw in the non-filtered air into a filter assembly; and filtering the airborne contaminants with the filter assembly. The method can further include monitoring the positive pressure, maintaining the positive pressure and adjusting the operation of the blower to ensure the positive pressure. In this embodiment, when the filter assembly is activated, more outside air is drawn into the HVAC unit than in normal operation.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
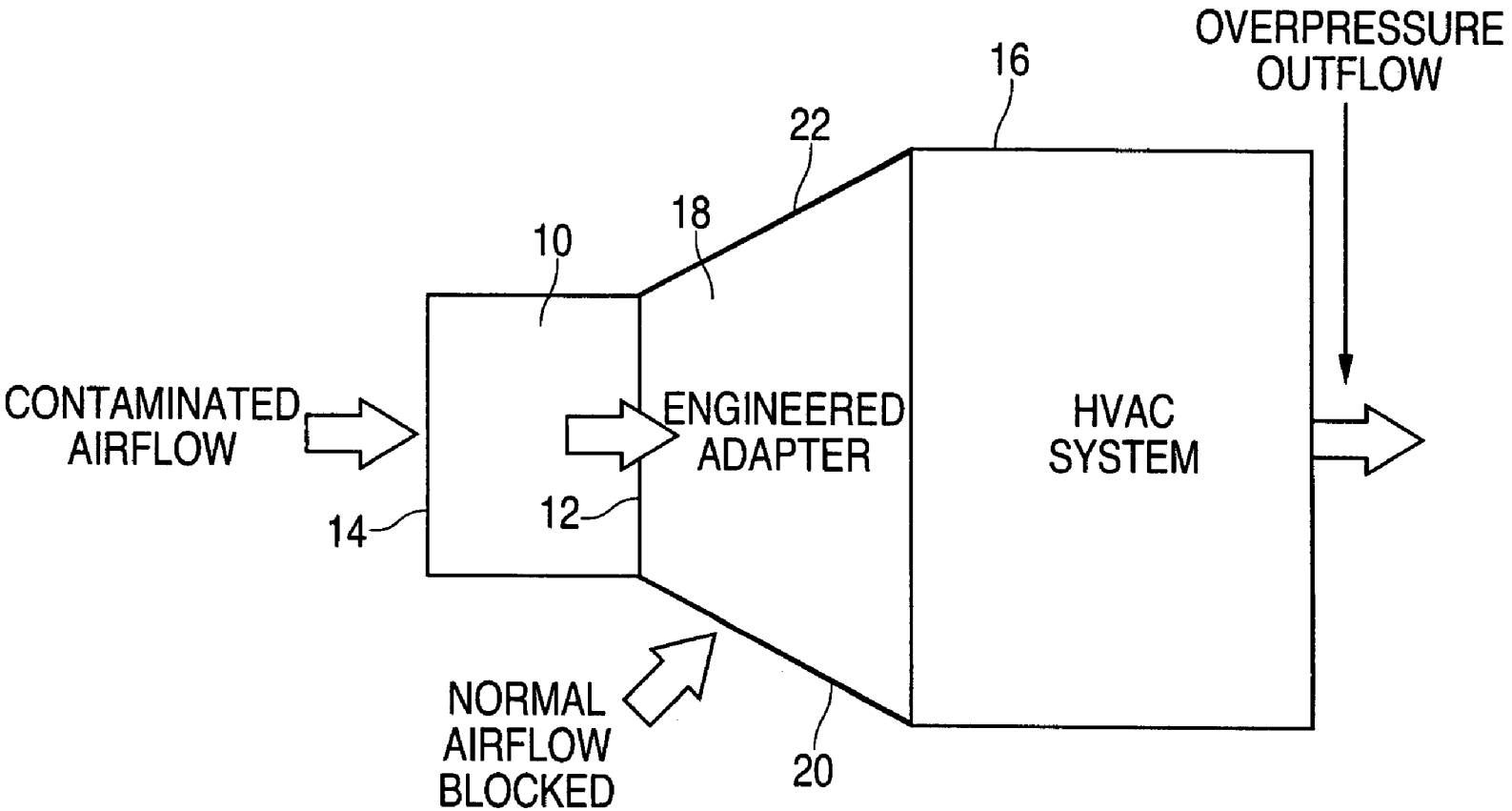
FIG. 1 is a high-level illustration according to a preferred embodiment of the invention.

The invention will now be described with reference to the drawing figures, in which like reference numerals refer to like parts throughout. An embodiment in accordance with the present invention provides a filter assembly that is attached to an existing HVAC unit. The filter assembly is activated in the instance that toxic contaminants become airborne. Without the filter assembly, the contaminants are drawn into the HVAC unit and rapidly spread throughout the building. The contaminants are then exposed to the inhabitants of the building.

In the present invention, the filter assembly draws the contaminated air into the HVAC unit through a filter to filter out contaminants. The filter assembly draws more outside air into the HVAC unit than in normal operation of the HVAC unit while return air decreases, causing a pressurization of the building. The filter assembly can have a single or multistage filter. The filter can be a HEPA or charcoal filter.

An embodiment of the present inventive apparatus and method is illustrated in FIG. 1. The apparatus includes an enclosure 10, which has a first opening 12 and a second opening 14. The first opening 12 is linked to the HVAC unit 16 via an adapter 18. The adapter 18 contains a plurality of openings 20, 22. These openings 20, 22 are used in a non-contaminated air situation or in a war-alert mode. The openings 20, 22 provide a path for the outside air to be drawn into the HVAC unit 16.

In a contaminated air situation, the openings 20, 22 are sealed. Air is then drawn into the HVAC unit 16 through the second opening 14 of the enclosure 10. As the air is drawn through the enclosure 10, a filter assembly located within the enclosure 10 removes any contaminants that are present in the air. This ensures that the toxic contaminants do not reach the inhabitants therein.

In this embodiment, an alert switch is used to activate the filtering process. The alert switch is connected to a control module. When the switch is activated either automatically or through manual operation, the openings 20, 22 are immediately sealed and a blower within the enclosure activated. The blower is run at a level to ensure that an overpressure is created to ensure that none of the outside air that might be contaminated is allowed to pass through to the HVAC unit. The overpressure in the HVAC unit 16 and the building acts as an invisible barrier to restrict airflow into the buildings.

Figure 2:
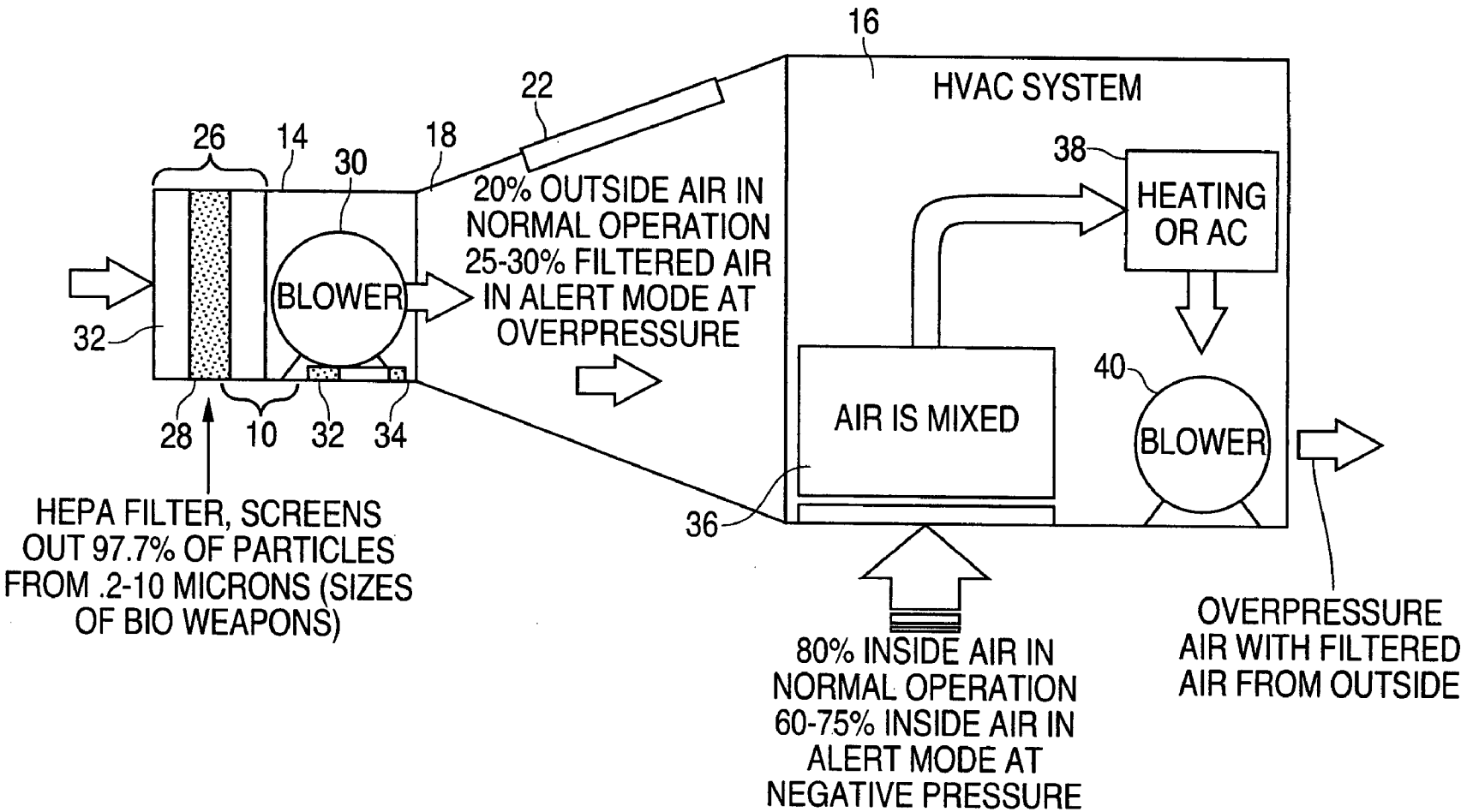
FIG. 2 is an exploded view of the illustration in FIG. 1, which details the preferred embodiment of the present invention.

FIG. 2 is an exploded view of the preferred embodiment of the present invention. As detailed in FIG. 1, the enclosure 10 is linked to the HVAC unit 16 via the adapter 18. The enclosure 10 is a housing for a filter assembly 26 and a blower 30. The filter assembly 26 includes at least one particle filter 28. The filter assembly 28 can be a single stage filter or a multi-stage filter.

In the single stage filter, which is the preferred embodiment, a HEPA filter is used to filter out the airborne contaminants. Generally, the size of airborne contaminants from bio or chemical weapons are of the order of approximately 0.2 microns to 10 microns. Varying particle filters of different screen size can be used to achieve the same goal.

In alternate embodiments, the filter assembly 26 can also be a multi-stage filter. The filter assembly contains a number of slots 32 that enable the user to create the multi-stage filter. Such multi-stage filters include a series or combination of charcoal and HEPA filters. These types of filters remove physical contaminants that are created with the explosion of a chemical, bio or nuclear explosive.

It is even possible to place a liquid removing filter such as silica gels or desiccant beads in the filter assembly to remove airborne liquid-based contaminants. In the same manner as the particle based filters, as the contaminated air is passed through the filter assembly 26, the contaminants are removed from the air being drawn into the HVAC unit 26.

Also located in the enclosure 10 is a blower 30 which is connected to a control module 32. The control module 32, in the preferred embodiment, includes a rheostat and a pressure measuring device such as a gauge. The control module is linked to an alert switch 34 and the blower 30.

The control module 32 accomplishes two tasks. One of the tasks is to measure the pressure within the HVAC unit 16 and the outside environment. The control unit 32 ensures that an overpressure or positive pressure is maintained within the HVAC unit 16 and the building to which the HVAC unit 16 is attached. By maintaining this overpressure, an invisible barrier is created to prevent outside contaminated air from entering the building. In other words, the overpressure creates an internal force that pushes the internal air towards the boundaries of the building.

In the preferred embodiment, the control module 32 is a commercially available fan rheostat that controls the airflow of the blower 30 that provides the desired overpressure to the HVAC unit 16. In alternate embodiments, the control module can be any suitable mechanical, electrical, analog or digital device capable of controlling the operation and airflow of the blower 30 to provide the desired overpressure to the HVAC unit 16.

The blower 30, in the preferred embodiment, operates on 110 VAC and provides approximately 10,000 to 20,000 cubic feet per minute of air volume. The blower 30 also creates an overpressure of about 0.01 to 0.5 inches of water gauge within the building. The level of overpressure required depends on the characteristics of the protected building.

The other task of the control module 32 is to ensure that the overpressure is maintained. To do this, the control unit 32 adjusts the operation of the blower 30. It does this through the use of a rheostat connected to the blower 30. The rheostat either increases or decreases the speed of the blower 30 to ensure that the overpressure is maintained.

The enclosure 10 is connected to an adapter 18. The adapter 18 links the enclosure 10 to the HVAC unit 16. The adapter 18 creates an air-flow path to allow the filtered outside air to pass directly into the HVAC unit 16.

The adapter 18 also serves as the entry for the drawing of air into the HVAC unit 16 in a normal non-contaminated air situations. The adapter 18 contains louvers 20, 22 that are placed in an open position in order to allow the outside air pass into the HVAC unit 16.

In the event of airborne contaminants present in the environment, the alert switch 34 is activated. Once the alert switch is activated, the louvers 20, 22 are closed to prevent the unfiltered air from being drawn into the HVAC unit 16. In the preferred embodiment, the overpressure present in the HVAC unit 24 is created by the activation of the blower 30. This activation creates a pressure in the system that causes the louvers 20, 22 to close.

In other alternate embodiments, the alert switch 34 can activate a mechanical device that closes the louvers 20, 22. The mechanical device can be a motor that alters the position of the louvers 20, 22 from an open position to a closed position.

When the alert switch 34 is activated, the blower 30 is activated. The blower 30 creates an overpressure in the system and begins to draw air in from the outside through the second opening 12 of the enclosure 10. As air is being drawn into the enclosure 10, it is passed through the filter assembly 26 to where the airborne contaminants are removed. In normal operation of the HVAC unit 16, the total air that passes through the unit is comprised of 20% of outside air that is drawn through the louvers 20, 22. When the switch is activated, known as alert mode, the percentage changes to a range of 25 to 30%. Therefore, in normal operation of the HVAC unit 16, 80% of air drawn into the HVAC unit 16 comes from the air presently in the building. Once it enters the HVAC unit 16, it is combined with the air drawn in from the louvers 20, 22. The combined or total air 36 is then passed through either a heating or cooling phase 38 and out of the system through a another blower 40.

In alert mode, the percentage of air drawn in from the building is reduced to a range of 60% to 75%. There is a reduction because more of the air that is pulled through the system needs to be filtered. It is possible that some of the internal air is contaminated with the airborne contaminants. Therefore, the system begins to filter more outside air to ensure that the contaminants from the outside are not allowed to penetrate the building.

To maximize the effectiveness of the overall filtering of the air, all air passageways leading into the HVAC unit 16 are sealed to prevent or reduce air infiltration. Sealing the HVAC unit 16 can be accomplished with polyethylene sheeting and adhesive. Alternate embodiments of the present invention utilize plastic polymer, rubber, or any other suitable air-impermeable material for sealing the HVAC unit 24.

The alert switch 34 in the preferred embodiment, is a mechanical device that is moved to an off and on position by having a user physically activate the device. However, it is possible to have the alert switch 34 linked to a sensor in order to detect contaminants in the outside air. In response to the detection of contaminants in the outside air by the sensor, the alert switch 34 is activated and filtering of the outside air is begun and all the louvers in the adapter are closed.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A filtration system for protecting occupants in an enclosed structure from airborne contaminants, comprising:

an enclosure having a first opening and a second opening, wherein the first opening is linked to a HVAC unit and the second opening is an intake for outside air to pass through the HVAC unit;

a filtration assembly mounted within the enclosure between the first and second opening;

a blower mounted within the enclosure and draws the outside air from the second opening to pass through the filter assembly, and an adaptor that connects the first opening of the enclosure to the HVAC unit, at least a set of louvers mounted within the adaptor and configured to move between an open and closed position, wherein unfiltered outside air is permitted to enter the HVAC system when the louvers are in the open position and unfiltered outside air is prevented from entering the HVAC system when the louvers are in the closed position.

2. The filtration system as claim 1, wherein the filtration assembly is comprised of a filter.

3. The filtration system as in claim 2, wherein the filter is a HEPA filter.

4. The filtration system as in claim 2, wherein the filter is a charcoal filter.

5. The filtration system as in claim 1, wherein the filter assembly is a multi-stage filter.

6. The filtration system as in claim 5, wherein the multi-stage filter comprises a HEPA and charcoal filter.

7. The filtration system as in claim 1, further comprising a control module attached to the blower.

8. The filtration system as in claim 7, wherein the control module monitors the pressure of the filtration system as compared to an outside environment.

9. The filtration system as in claim 7, wherein the control module detects and monitors the pressure of the filtration system as compared to an outside environment with a pressure gauge.

10. The filtration system as in claim 8, wherein the control module creates a positive air pressure in the filtration system as compared to the outside environment.

11. The filtration system as in claim 8, wherein the control module comprises a rheostat to adjust a operation of the blower.

12. The filtration system as in claim 11, wherein the rheostat is adjusted based upon the detection of the pressure of the filtration system as compared to the outside environment.

13. The filtration system as in claim 1, further comprising an alert switch connected to the control module.

14. The filtration system as in claim 13, wherein the alert switch, in response to activation, seals at least a non-filtered intake vent.

15. The filtration system as in claim 14, wherein the non-filtered intake vent provides a passageway through which outside air passes directly into the HVAC unit.

16. The filtration system as in claim 10, wherein the positive air pressure an HVAC air exit ranges from approximately 0.01 to approximately 0.5 inches of water.

17. The filtration system as in claim 1, wherein the blower assembly operates at approximately 10,000 to approximately 20,000 cubic feet per minute.

18. The filtration system as in claim 3, wherein the HEPA filter screens out particles from approximately 0.2 microns to approximately 10 microns.

19. A method of filtering airborne contaminants such that they do not contaminate a HVAC system located within an inhabited enclosure comprising:

sensing airborne contaminants in an outside environment;

closing intake vents that draw in non-filtered air into the HVAC system;

activating a blower to draw in the non-filtered air into a filter assembly; and filtering the airborne contaminants with the filter assembly and providing an adaptor that connects a first opening of the enclosure to the HYAC unit, at least a set of louvers mounted within the adaptor and configured to move between an open and closed position, wherein unfiltered outside air is permitted to enter the HVAC system when the louvers are in the open position and unfiltered outside air is prevented from entering the HVAC system when the louvers are in the closed position.

20. The method as in claim 19, wherein the step of activating the blower creates a positive pressure.

21. The method as in claim 20, further comprising using a control module to monitor the positive pressure.

22. The method as in claim 20, further comprising adjusting the operation of the blower to ensure the positive pressure.

23. The method as in claim 22, further comprising increasing the amount of outside air drawn through the HVAC system in the presence of airborne contaminants as opposed to normal operation of the HVAC unit without the presence of airborne contaminants.

24. The method as in claim 23, wherein the outside air comprises approximately 25 to approximately 30 percent of air drawn into the HVAC unit.

* * * * *

UNITED STATES PATENT AND TRADEMARK OFFICE

CERTIFICATE OF CORRECTION

PATENT NO. : 6,976,911 B2
DATED : December 20, 2005
INVENTOR(S) : Gerry Lanham et al.

It is certified that error appears in the above-identified patent and that said Letters Patent is hereby corrected as shown below:

Title page,
Item [56], References Cited, U.S. PATENT DOCUMENTS, insert
-- 5,538,471 A 7/1996 Guiles, Jr. 454/238 --.

Column 8,
Line 1, delete "HYAC unit" and insert -- HVAC unit --.

Signed and Sealed this

Twenty-eighth Day of March, 2006

JON W. DUDAS
*Director of the United States Patent and Trademark Office*